United States Patent [19]

Johnson

[11] Patent Number: 4,715,447

[45] **Date of Patent: * Dec. 29, 1987**

[54] QUICK RESPONSE AUTOMATIC FIRE SPRINKLER HEAD

[76] Inventor: Kimball W. Johnson, 36 Rocky Hill Rd., Oxford, Mass. 05140

[ * ] Notice: The portion of the term of this patent subsequent to Jun. 24, 2003 has been disclaimed.

[21] Appl. No.: 867,945

[22] Filed: May 29, 1986

Related U.S. Application Data

[63] Continuation-in-part of Ser. No. 732,677, May 10, 1985, Pat. No. 4,596,289.

[51] Int. Cl.[4] ..... A62C 37/08

[52] U.S. Cl. ..... 169/37

[58] Field of Search ..... 169/37–41; 137/72

[56] References Cited

U.S. PATENT DOCUMENTS

| | | | |
|---|---|---|---|
| 1,371,043 | 3/1921 | MacGregor | 169/40 |
| 3,195,647 | 7/1965 | Campbell et al. | 169/40 |
| 3,866,686 | 2/1975 | Goodsell, Jr. et al. | 169/39 |
| 4,105,076 | 8/1978 | Simons et al. | 169/40 |
| 4,596,289 | 6/1986 | Johnson | 169/37 |
| 4,618,002 | 10/1986 | Mears | 169/37 |

*Primary Examiner*—Jeffrey V. Nase

*Attorney, Agent, or Firm*—Herbert L. Gatewood

[57] ABSTRACT

Fire sprinkler head suitable for mounting in a concealed location in the ceiling in a residential dwelling which provides quick and automatic response in the event of a fire. The valve assembly in the sprinkler head is biased to the open mode and is maintained in the closed mode against a positive force, provided by at least the pressurized fire extinguishing fluid, tending to move the valve assembly to the open mode, by a valve closure unit which is separable into its two sections at the onset of a fire. The two sections of the valve closure unit are maintained intact as a unit by a heat responsive member until the ambient temperature causes a heat fusible alloy composition to melt whereby any resistance to separation of the divided valve closure unit is removed and the positive force against the valve assembly causes it to be moved to the open position at the same time causing the valve body member to be retracted from the sprinkler head outlet, and allowing discharge of the fire extinguishing fluid onto the fire.

31 Claims, 5 Drawing Figures

QUICK RESPONSE AUTOMATIC FIRE SPRINKLER HEAD

CROSS-REFERENCE TO RELATED APPLICATION

This patent application is a continuation-in-part of my earlier field application, Ser. No. 732,677, filed May 10, 1985 for "Quick Response Automatic Fire Sprinkler Head" now U.S. Pat. No. 4,596,289.

BACKGROUND OF THE INVENTION (1) Field of the Invention

This invention relates, in general, to fire extinguishing sprinkler heads, and, in particular, to an improved, automatic sprinkler head that can be mounted substantially flush with the ceiling of a fire protected enclosure.

(2) Description of the Prior Art

Sprinkler systems are used extensively to provide automatic fire protection for residential, commercial and public buildings. A sprinkler head to qualify as suitable for use in a residential sprinkler system must pass many tests, several of which go beyond those normally used for ordinary commercial/industrial type sprinkler heads. The two greatest distinctions between such ordinary, and residential-type, sprinkler heads are the operating speed and specially designed water spray patterns that fire tests have revealed are necessary to combat or extinguish a fire in typical residences. The residential type sprinkler head must operate at a faster speed than the ordinary commercial/industrial sprinkler head, the faster the better, as the protection of human life in involved. Thus, there is a keen interest in providing residential sprinkler heads with ever shorter times to become operable.

In residential dwellings, moreover, and sometimes even in commercial buildings, it is most desirable to utilize a sprinkler head that can be located almost entirely above the ceiling so as to be hidden, or concealed, from view, leaving the attractiveness of a room relatively unspoiled.

Exemplary of prior Art showing concealed fire sprinkler heads are U.S. Pat. Nos. 3,633,676; 3,756,321; 4,015,665; 4,105,076; 4,465,141; 4,491,182 and 4,508,175.

The automatic fire sprinkler head, whether of the commercial/industrial type or one for residential dwellings, comprises, in general, an elongated body member which is open at one end, and connected to a pressurized fire extinguishing fluid, e.g. water, and is closed at the other end by a valve assembly, or mechanism which operates to open the valve in response to a fire. The valve body member ordinarily is maintained in the closed position by the assembly, in part, by a low melting point fusible composition, until the occurrence of a fire. With such an occurrence, when the ambient temperature rises to a predetermined level, the fusible composition melts, resulting in the valve mechanism operating to open the valve, i.e., move the valve body member from the closed position to the open position, thereby allowing the discharge of the fire extinguishing fluid onto the fire.

Of the above disclosed patents, U.S. Pat. Nos. 4,491,182 and 4,508,175 both disclose the fusible element contained in the bottom of what might be termed an open-top cylindrical container, or "housing", as disclosed in U.S. Pat. No. 4,508,175. Heat is supplied to the fusible composition, in both cases, by one or more circular-shaped heat collecting fins carried by the housing. In U.S. Pat. No. 4,508,175 there is disclosed, moreover, an insulating disc resting on top of the heat fusible composition, which along with the insulating ring separating the housing from the sleeve holding it, apparently confines the heat collected by the fins, to the housing, whereby that heat, rather than being dissipated to other parts of the valve assembly is directed to the melting of the heat fusible material.

SUMMARY OF THE INVENTION

The invention disclosed herein, in general, is a fire sprinkler head of novel construction suitable for mounting in the ceiling of a room to be fire protected, in a residential dwelling, and which operates automatically to release fire extinguishing fluid, to be discharged therefrom onto a fire, when a certain predetermined ambient temperature is reached. The fire sprinkler head disclosed herein can be mounted in the ceiling of a room in such a manner that it is essentially concealed from view whereby the sprinkler head can most desirably be used in residential dwellings without adversely affecting the aesthetic features in the surroundings.

Quite advantageously, moreover, the fire sprinkler head of this invention offers features of construction that provide not only a rapid response time in its operation but also certain economies in manufacture.

In its more basic aspects, the fire sprinkler head of the invention comprises an elongated body member having an inlet end for connection to a supply of pressurized fire extinguishing fluid and an outlet end for discharge of that fluid onto a fire, a central passageway in said body member connecting said inlet end to said outlet end, an outwardly extending flange at said outlet end connected to and surrounding the said body member, two spaced-apart openings being provided in said flange located on an imaginary line and on opposite sides of said body member, a housing for said elongated body member open at the bottom end thereof and provided with a horizontally disposed, planar top closure through which said inlet end of said body member extends, a valve assembly automatically operable to an open position from a closed position at a predetermined ambient temperature with the onset of a fire comprising a horizontally disposed circular-shaped deflector plate located adjacent to and beneath said outwardly extending flange on said body member, a plurality of horizontally extending teeth being provided uniformly and in spaced-apart location around the circumference of said circular-shaped deflector plate, a valve body member located centrally on and supported by said deflector plate which, when the valve assembly is in its closed position, intrudes into said outlet end, means being located on said valve body member for providing positive seal of said outlet end when the said valve assembly is in the closed position, two spaced-apart vertically disposed elongated struts parallel to one another and each extending through respective said spaced-apart openings in said flange, each said strut being connected at its bottom end to said deflector plate and in combination therewith, the improvement comprising a valve closure means located in the open bottom of said housing for maintaining the valve assembly in the closed position until the attainment of said predetermined ambient temperature with the onset of a fire comprising a planar horizontally disposed member divided into two sections along a dividing line therefor, and being so oriented with respect to the imaginary line along which said spaced apart openings in said flange are located that the said dividing line of the horizontally disposed divided member is perpendicular thereto, and means responsive to heat for maintaining the two sections intact as a unit until the onset of a fire and the attainment of said predetermined ambient temperature surrounding the fire sprinkler head whereby until the onset of a fire and the attainment of said temperature the valve assembly is maintained in the closed position against a positive force predetermined by the said fire extinguishing fluid, a centrally disposed opening being provided in said divided member and being divided by said dividing line, said heat responsive means comprising in combination a horizontally disposed member being constructed of relatively high heat conductive material and having a centrally disposed elongated body member open at the bottom end thereof and having a top closure, an opening being provided in said top closure of predetermined size and said bottom end being determined and surrounded by an annular shaped, planar, horizontally disposed flange, an elongated circular-shaped member having a head at one end of somewhat larger size than the opening in said top closure and extending therethrough, a thread pattern being provided on the circumference of said elongated member at the other end, said other end extending through the centrally disposed opening provided in the said horizontally disposed divided member, an annulus of eutectic composition of predetermined melting point surrounding said threaded elongated member and being disposed between the head of said elongated member and said top closure in the centrally disposed elongated member, an annular shaped insulating member surrounding said elongated member and being disposed between said divided member and said centrally disposed elongated member, and a member provided with an internal thread pattern complementary to that on said elongated member disposed on the side of said horizontally disposed divided member opposite that of the said insulator, and being threaded onto said elongated member whereby the said divided member, the annular-shaped insulator, the eutectic annulus and heat conductive member are all held together, until the onset of a fire and the attainment of the said ambient temperature.

In a more preferred aspect of the fire sprinkler head invention disclosed herein, the housing for the elongated body member comprises a bottom housing section and a top housing section, detached therefrom. The top housing section can advantageously, be made of suitable plastic material as it provides no support for any of the sprinkler components and merely serves as a protective cover.

A further preferred embodiment of the fire sprinkler head invention is provided with an expandable member in combination with the valve assembly providing even more rapid response and for positive, rapid response in the operation of the sprinkler head, even if, for some reason, the pressurized fire extinguisher fluid should be at less than the desired pressure.

In a still further preferred embodiment of the invention there is provided an expandable member as a part of the valve assembly, in operative combination with the deflector plate and the valve closure means. Thus, there is provided positive and rapid dissassembly of the valve closure means, allowing the valve body member to be rapidly ejected from the outlet end of the elongated body member, and the attendant discharge of the fire extinguishing fluid onto the fire.

BRIEF DESCRIPTION OF THE DRAWING

The novel features and operation of the fire sprinkler head of the present invention will be better understood by reference to the drawing, in conjunction with reading the following description, in which.

DETAILED DESCRIPTION OF THE INVENTION AND THE PREFERRED EMBODIMENT

Figure 1:
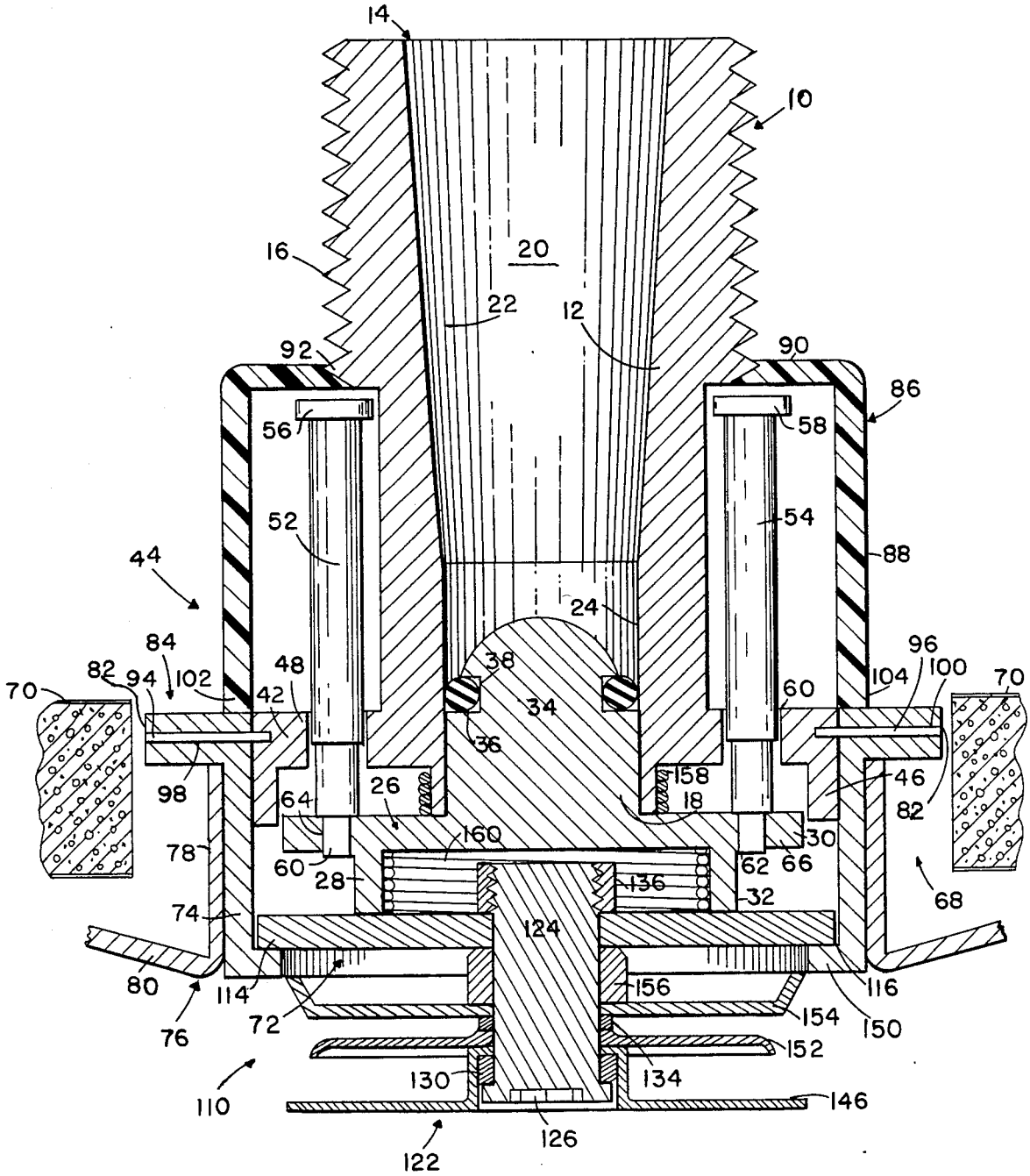
FIG. 1 is a schematic, vertical, cross-sectional view of the most preferred sprinkler head according to the invention.
Figure 2:
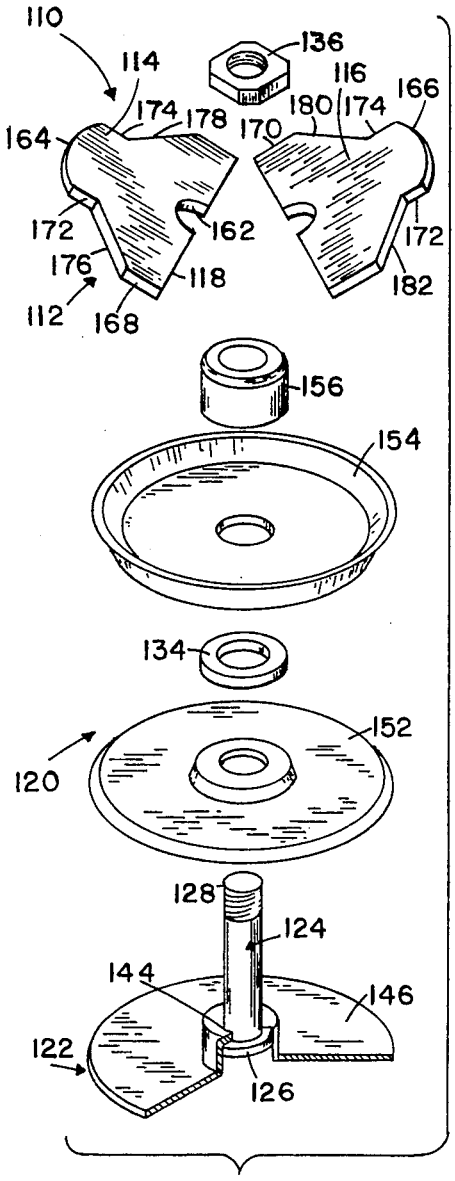
FIG. 2 is an exploded view, in perspective, of the valve closure means of the sprinkler head shown in FIG. 1.
Figure 3:
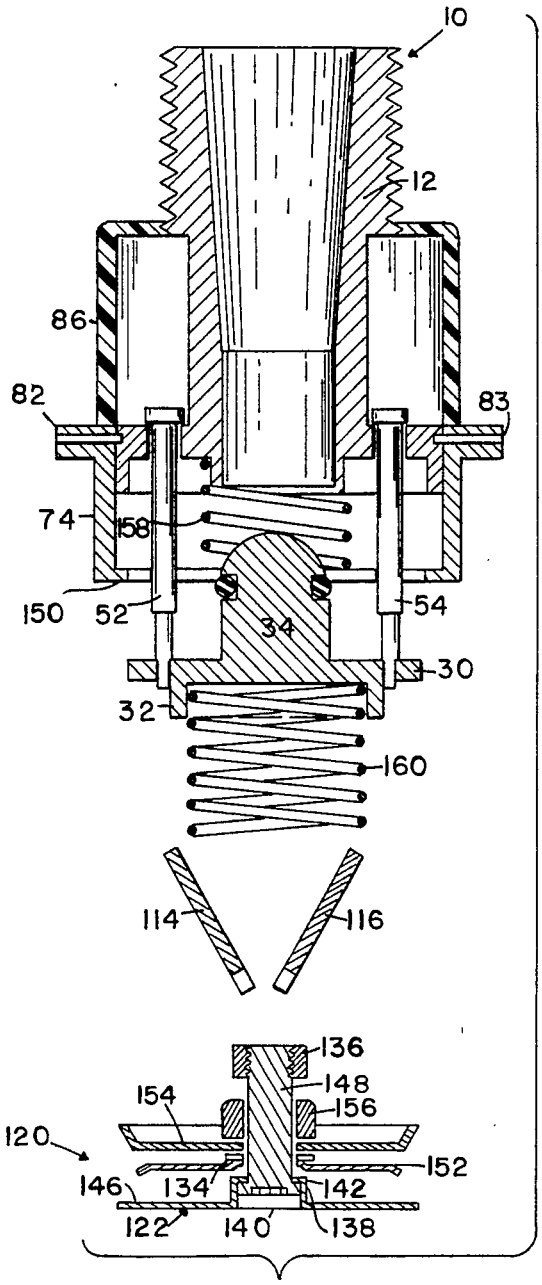
FIG. 3 is a schematic, vertical, cross-sectional view of the most preferred sprinkler head according to the invention, as shown in FIG. 1, but showing the valve assembly in the full open position.

Illustrated in FIGS. 1–3 of the drawing is the fire sprinkler head 10, showing the more preferred construction and embodiment of the invention. Sprinkler head 10 comprises an elongated body member 12 which is provided at the upper, or inlet, end 14 thereof with an external thread pattern 16 for connection of the sprinkler head 10 to a conventional overhead fire sprinkler system through an internally threaded female socket, not shown. The elongated body member 12, as will be seen from FIG. 1, terminates at outlet end 18, and the inlet and outlet ends are connected by a centrally located passageway 20. As is shown in the drawing, passageway 20 tapers inwardly for a predetermined distance from the inlet end 14 and then below that portion 24 is of cylindrical shape, continuing to outlet end 18. Thus, in accordance with well known properties of fluid flow, when the fire extinguishing liquid passes through passageway 20, its velocity increases because of the narrowed passageway, attendant with a somewhat decreased pressure, resulting in a highly suitable discharge flow from outlet end 18 toward and against deflector plate assembly 26—(See FIG. 3), and hence, a pattern of fire extinguishing liquid on a fire, more suitable to fires in residential dwellings. The extent of taper and the length of the tapered portion of the passageway 20, as well as the diameter of the cylindrical portion 24 will depend, among other things, upon the fluid velocity desired and the pressure thereof, all of which is within known and conventional design techniques.

Deflector plate assembly 26, as is evident from the drawing, comprises a horizontally disposed, circular-shaped member 28 which is provided at its peripheral edge with a plurality of spaced-apart-teeth 30 between each adjacent two of which is provided a slotted opening (not shown), according to usual design. The teeth 30 are, in general, of uniform dimension and size and are spaced uniformily from one another, the exact requirements and specifications therefor being set, in any particular case, by Underwriter Laboratories, Inc. Thus, when the fire extinguishing fluid discharges from outlet end 18 and strikes the horizontally disposed deflector plate or member 28 of deflector plate assembly 26, the teeth 30 provide the desired spray pattern on the fire.

Depending vertically downwardly from the bottom side of member 28 is an annular member or ring, 32, the purpose for which will later be disclosed. This ring is desirably manufactured integral with deflector plate 28, however, it can also, if desired, be manufactured separately and attached to that member 28 by various, suitable means known to the art. The diameter of the ring can be varied somewhat, so long as it provides the function for which it is used, as later more fully disclosed.

Figure 4:
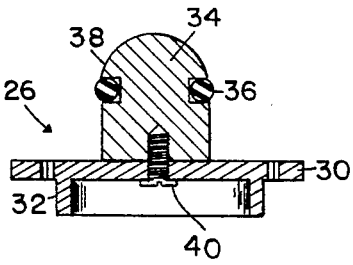
FIG. 4 is a vertical, cross sectional view of a further valve body member and deflector plate combination, suitable for use in the practice of the invention.

The valve body member or plug 34, as shown in FIG. 1, intrudes into outlet end 18 and is provided with a conventional o-ring seal 36 located in annular groove 38, for providing a positive seal against discharge of the pressurized fire extinguishing fluid when the valve assembly is in the closed position. Valve plug 34 is centrally disposed on, and is supported by, the horizontally disposed member 28 of the deflector plate assembly 26 and can be manufactured as an integral part thereof, if desired, as shown in FIGS. 1 and 3. Nevertheless, valve body member 34 can, instead, be manufactured separately from the deflector plate assembly 26 and attached thereto by various known means, e.g. screw 40, if desired, as is shown in FIG. 4. Moreover, as will be appreciated by those skilled in the art, the valve body member 34 need not be dome-shaped, as shown in the drawing. Other shapes can be used, as known to the art.

At outlet end 18, elongated body member 12 is provided with a flange 42, the purpose for which will be disclosed subsequently. Flange 42, which extends perpendicularly outwardly from body member 12, is of annular shape and is integral with and surrounds the body member 12. Nevertheless, it will be appreciated that flange 42 need not necessarily be integral with the body member nor of annular shape. It can be separately manufactured, if desired, and subsequently permanently connected to the body member by known techniques. Further, the entire periphery of the flange 42 while desirably circular, can be any shape desired, e.g., polygonal. This depends somewhat on the cross-sectional shape of housing 44, to be later more fully disclosed. Importantly, however, flange 42 is permanently connected at its outer peripheral edge to the housing 44, one means of doing so to be later described. The flange 42 is optionally provided with a downwardly extending annular ring 46, providing additional strength thereto, as desired. Flange 42 is provided with two spaced-apart openings 48, 50 located on an imaginary line and on opposite sides of the body member 12, as shown.

Extending vertically upwardly from deflector plate 28 are two spaced-apart, parallel, struts 52, 54 which terminate at their top ends in respective flat heads 56, 58. As shown in FIG. 1, struts 52, 54 pass through respective openings 48, 50 in flange 42 and the bottom ends 60, 62 thereof are connected to deflector plate 28 in respective openings 64, 66.

As seen from the drawing, elongated body member 12 and the operating parts of the valve assembly are contained within housing 44. This housing is mountable in a hole 68 in the ceiling 70 of a room in such a fashion that the bottom opening 72 of the housing is substantially flush with the ceiling 70, though shown somewhat exaggerated in the drawing for the sake of clarity. Surrounding the bottom portion 74 of housing 44 is a decorative plate 76 having a cylindrical portion 78, surrounding the outside of bottom portion 74, and an upwardly and outwardly extending portion 80, to cover and conceal the hole 68 in the ceiling. The inside diameter of cylindrical portion 78 can be such as to provide a press-fitting engagement of the decorative plate 76 with the bottom portion 74 of the body member 44 such that it can be removed therefrom, as desired, in the event it becomes necessary to replace, or to install a new, sprinkler head 10, in the fire sprinkler system. The decorative plate 76 can, if desired, be threaded onto body member 44. To accomplish this an external thread pattern (not shown) could be provided on bottom portion 74, and an inwardly extending annular flange (not shown) provided on, and at the upper end of, cylindrical portion 78 for engagement with the thread pattern. Other means of detachably connecting decorative plate 76 to the housing 44 will be obvious to those skilled in the art.

As will be readily appreciated, an automatic sprinkler head 10 of the invention is installed into a fire sprinkler system by threading it into a female fitting, not shown in the drawing. To facilitate this, wrench flats 82 are provided on flange 84 which extends horizontally outwardly from body portion 74. These flats can provide for use of various wrenches, as desired, e.g. hexagonal socket wrench construction similar to that of the convention "spark plug" wrench.

Housing 44 can be of unitary construction, as disclosed in the parent application, earlier mentioned. Nevertheless, it will be particularly advantageous and offer certain economies in construction in the practice of the invention to provide housing 44 having a bottom portion 74 and a top portion 86. Thus, top portion 86 can be constructed of less expensive material, e.g., various plastic materials, than bottom portion 74, as it merely serves as a protective cover surrounding the struts 52, 54. The construction of the body portion 74 will, on the other hand, be constructed of load bearing material, conventionally used for the construction of automatic sprinkler heads. Other materials may be found suitable, however, for example, various plastic materials found useful in plumbing applications and as substitutes where metal has conventionally been used in the past but is now being replaced by high strength, durable plastic components.

As shown in the drawing, top portion 86 has a vertically extending cylindrical portion 88, the bottom edge of which contacts bottom portion 74 atop annular flange 84. The housing top portion is closed by planar, horizontally disposed end member 90, in which is provided circular-shaped opening 92, of desired diameter, depending on the outside diameter of inlet end 14. As seen by reference to the drawing, the inlet end of elongated body member 12 extends through opening 92 which opening engages with thread pattern 16.

Bottom portion 74, in the more preferred aspect of the invention, as shown in FIG. 1, is joined to body member 12, at the flange 42 by elongated circular-shaped locking pins 94, 96. These pins extend inwardly through circular shaped, horizontally-disposed openings 98,100, extending through flange 84, into circular-shaped dead bores 102, 104. Two such pins, as shown in FIG. 1 of the drawing, will generally be sufficient to secure bottom portion 74 of housing 44 to the elongated body member 12; however, additional pins can be provided, if desired, the location of which should be that any two pins are diametrically opposed to one another, as are pins 94, 96.

Figure 5:
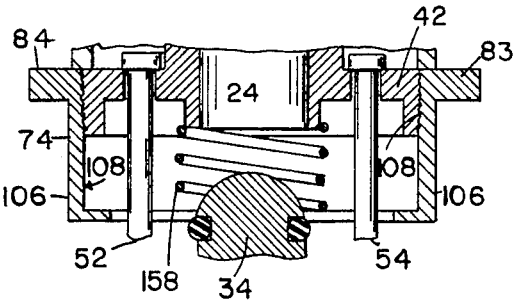
FIG. 5 is a partial, cross-sectional view, showing a further embodiment of a fire sprinkler head, according to the invention.

Instead of using locking pins to secure the housing 44 to the elongated body member 12, other securing means can be used, as will be readily appreciated by those skilled in the art. One example of such another securing means is shown in FIG. 5. Illustrated in FIG. 5 is a bottom portion 74 with an internally provided thread pattern 106, which matches with thread pattern 108 provided on the outer peripheral edge of flange 42. In this case, it may be desirable to provide thread pattern 106, in a direction counter to that of thread pattern 16.

In the open bottom 72 of the bottom housing portion 74 there is provided valve closure means denoted generally by reference numeral 110. Valve closure means 110, as will be more readily appreciated by reference to FIG. 2 comprises, in the most preferred aspect of the invention, in combination, a planar, horizontally disposed member 112 divided into two sections 114, 116, along a dividing line 118 therefor, the reason for which will be later more fully explained, and a heat responsive means, denoted generally by reference number 120, for maintaining the divided member 112 intact as a unit, until the rise of the ambient temperature to a predetermined level with the onset of a fire. Heat responsive means 120 comprises in critical combination, horizontally disposed member, or heat cup, 122, elongated circular-shaped member 124 having a head 126 at one end thereof, and a thread pattern 128 at the other end, an annulus of eutectic composition 130 (See FIG. 1), an insulator 134 of annular shape, and a locking nut, or internally threaded member, 136, which is threaded onto the threaded end 128 of the elongated member, or locking screw, 124. As well be appreciated by reference to the drawing, heat cup 122 comprises centrally disposed, somewhat elongated, body member 138 having an open bottom 140, and being closed at the top by means of a horizontally disposed top closure 142, in which is provided circular-shaped, centrally disposed opening 144. The bottom end of body member 138 is determined and surrounded by an annular shaped, planar, horizontally disposed outwardly extending heat collecting flange 146, thus providing a construction approximating that of a man's hat, having a wide brim. The head 126 of lock screw 124, which as illustrated is flat, is somewhat larger in diameter than opening 144 so that only barrel 148 of the lock screw will pass therethrough. As a result, the components of the valve closure means can be assembled together and held intact as a unit, until the onset of a fire and the rise in the predetermined ambient temperature, resulting in melting of the heat fusible material (or eutectic composition).

Heat cup 122 is constructed of relatively high heat conductive material and in combination with insulator ring 134, functions as a heat sink whereby heat is available and focused onto the eutectic composition 130 for rapid melting thereof. The amount of heat available for this purpose depends to a large extent upon the area of the outwardly extending heat collecting flange 146, i.e. the area of the heat sink available, as this member is exposed directly to ambient temperature conditions, and its material of construction. The heat sink properties of this flange, moreover, depends upon the particular metal used for its construction, as well as upon the thermal conductivity thereof, all according to well known engineering principles. In general, however, for any particular material of construction used, the greater the heat conductivity thereof, the greater the heat sink properties for that particular heat collector. Moreover, the greater the area of the heat collector, the greater, in general, the amount of heat available which can be focused upon the eutectic ring, to cause the heat fusible material to melt. Thus, the greater the area of the heat collector, the more rapid the response time to operation of the fire sprinkler, as the eutectic composition is caused to melt more rapidly. Nevertheless there is a balance that must be maintained between the total area of the heat collector and the mass thereof, I have discovered, for optimum practice of the invention, due to the fact that, as the mass increases the response time also increases. Thus, if the total area of the heat collector provided is too large, the response time to operation will be unduly long. In the practice of the invention, it will be found that best results will be obtained with the desired area being provided with fewer heat collecting members or fins of somewhat larger diameter than with a larger number of such fins of somewhat smaller diameter. Thus, it will be found that good results are provided when, as illustrated in the drawing, the diameter of the heat collecting fin is approximately that of the inside diameter of housing portion 74, considering the annular lip 150 at the bottom outlet of the housing upon which divided member 112 rests, as shown in FIG. 1. The best results will be found, in the practice of the invention, when, additionally, heat collecting fin 152 is provided, in combination with heat cup 122. This fin, like heat cup 122, is constructed of relatively high heat conductive material, e.g. copper. Heat collecting fin 152, moreover, is manufactured separate from heat cup 122, and both can be readily stamped from stock, offering economies in manufacture, not found with heat collectors in known prior art fire sprinkler heads.

As earlier disclosed, the diameter of heat collecting flange 146 will be approximately that of the inside diameter of housing portion 74, taking into account annular lip 150. Thus, where the inside diameter 20 of the housing is, e.g. 1.00", the diameter of flange 146 may be approximately 0.99"; however, this may vary somewhat depending upon, among other things, the thickness of the flange, the particular material of construction used, etc. In any event, the diameter should be no greater than the inside diameter of bottom portion 74, as will be later explained.

The heat collecting members, as these members extend below the surface of the ceiling 70, can be chrome-plated, or otherwise made more decorative, as desired. Nevertheless, where doing so, one must take into consideration any possible adverse effects upon the thermal properties of these heat collectors. It will be appreciated also that the larger the diameter of the heat collecting members, taking into consideration the requirements earlier disclosed, results in fewer such members being necessary, with attendant better aesthetic results.

Heat responsive member 120, in its more preferred aspects, as shown in FIG. 2 comprises decorative plate 154, next adjacent insulator ring 134, the sole purpose for which is to conceal from view the bottom opening 72 in housing portion 74, and divided member 112. Next adjacent decorative plate 154 is annular spacer ring 156 which abuts against divided member 112, as shown in FIG. 1. The divided member 112, as illustrated in FIG. 2, is the most preferred configuration for this member in the valve closure means of this invention. As shown, the divided member comprises the two sections 114, 116, which are mirror images of one another. Intact, the two sections are defined by dividing line 118 which, in FIG. 1 lies, perpendicular to the imaginary line connecting the center of openings 48, 50. Nevertheless, this orientation, as will be appreciated, is not critical in the practice of the invention, in view of annular fulcrum ring 32. The dividing line 118 cuts acros and divides centrally disposed opening 162 which, as shown in FIG. 1, provides a means of passage for lock screw 124. Thus, the various components of the valve closure means of the invention can be pre-assembled together, as a unit, and held together, when lock nut 136 is threaded onto the lock screw 124. This is of particular importance as this readily allows, and facilitates, assembly of the fire sprinkler head components, in its manufacture, as later described. The divided member 112, intact, as illustrated in FIG. 2, is defined by the curved ends, or edges, 164, 166, the curvature of which is determined by the inside diameter of housing portion 74, the parallel outer side edges 168, 170, the inner parallel side edges 172, 174 and respective connecting edges 176, 178, 180, and 182. Thus, there is provided a divided, valve locking or latching member 112 that readily separates into its two sections, and dissociates itself from the housing, without any chance for hang-up, at the critical time the sprinkler head must become operative. Nevertheless, though the particular configuration for the divided locking member 112, illustrated in FIG. 2, is most preferred, satisfactory, and efficient, results in operation will generally be found when the divided member is of circular shape, each section thereof being the shape of a half moon.

As readily appreciated by those skilled in the art of fire sprinkler heads, heads of different sizes are provided, as the market desires. Nevertheless, one must take into critical consideration in the manufacture of any fire sprinkler head, according to the invention disclosed herein, not only the thickness of the divided latching member 112 but also that of the annular ring of eutectic composition 130 (FIG. 1). In general, the two components should be of the same thickness, otherwise, the two sections 114, 116 do not have sufficient vertical distance at the dividing line 118, as hereinafter made more clear, to drop downward, and to pivot downwardly with respect to one another, as shown in FIG. 3, whereby to allow the valve plug 34, to be readily and rapidly ejected from outlet end 18, if at all. Nevertheless, at the same time, the divided member 112 must be sufficiently thick, to offer suitable strength thereto and resistance in keeping the valve body member 34 in the closed position, until the onset of a fire, but not too thick whereas to result in a necessarily thicker ring of eutectic, attendant with somewhat slower response times. Good results have been experienced, in the practice of the invention, where the divided member has a thickness no greater than 0.050 inches. In this case, a ring of eutectic composition (e.g. Cerrobend 158) having an inside diameter measuring 0.019 inches and an outside diameter measuring 0.030 inches provided good results, when the thickness thereof was at least 0.050 inches; however, at a thickness of 0.045 inches, the two sections of the divided member did not readily separate, and instead, hung-up, with respect to one another. Desirably, the thickness of the eutectic ring is no greater than about 0.050 inches, as the thicker the eutectic ring at any particular diameter, the more eutetic there will be to melt, and the longer the response time will necessarily be. It will be readily appreciated, however, that other eutectic composition may require somewhat different dimensions for optimum results. The eutetic ring 130, as shown in FIG. 1, has an outside diameter approximately that of the inside diameter of the body member 138.

Various eutectic compositions are available and known to those skilled in the fire sprinkler art, the choice of which will depend somewhat upon the ambient temperature, in which a fire sprinkler head desirably will operate. Generally, a heat fusible material will be chosen that melts in the range of about 135° to 180° F. Annular rings of the desired eutetic composition can be purchased, or such can be readily made from a mass of such material being melted and formed into rings having the desired dimensions.

The more preferred embodiment of the invention will include, as shown in FIG. 1, an expandable member 158, such as a coiled spring, which provides, on expansion, additional downward force, to rapidly eject valve body member 34 from the outlet end 18, allowing discharge of the fire extinguishing fluid onto the fire. This additional force not only provides more rapid ejection of the valve body member but also provides positive ejection thereof, in case the pressure of the fire extinguishing fluid is, for some reason, not sufficient to readily accomplish this purpose. Additionally, there is desirably provided a further expandable member 160, located within the confines of the annular ring 32, which ring, as later more fully explained, acts as a fulcrum ring to cause the divided sections 114, 116, to pivot downwardly. Expandable member 160, like member 158, is held in the compressed mode by the valve closure means.

In some applications, it may be desirable to provide even more rapid movement downwardly of the elongated struts 52, 54. Whenever such is desired, a bushing (not shown) can be provided on threaded inlet 16, as disclosed in the parent of this patent application, to provide a back resistance to placement of an expandable member (not shown) located adjacent the heads 56, 58, in the compressed mode. In that case, it may also be found desirable to provide an annular strut directing member connecting the ends of the struts together, as disclosed in my parent application.

In operation, as will be appreciated more particularly by reference to FIGS. 1 and 3, with the onset of a fire, the rise in the ambient temperature surrounding the fire sprinkler head 10 and particularly the heat collecting member thereof causes melting of the ring 130 of heat fusible material. This results then in the melted eutectic escaping around the perimeter of the head 126, resulting in the heat cup 122 dropping vertically downwardly against head 126, along with the vertical dropping of fin 152, insulator ring 134, decorative cover plate 154, and spacer 156. When this occurs, there no longer is anything holding the divided sections 114, 116 intact and these two sections are allowed to separate from one another. The downward movement of the valve body member 34, then causes the two sections 114, 116 to pivot downwardly and away from one another, as shown in FIG. 3. This pivotal movement is facilitated through action of the annular ring 32 pressing downwardly against the divided member 112 and acting as a continuous fulcrum point thereagainst due to the support of end edges 164, 166 on the annular lip 150 of the housing. The potential downward forces in the compressed, expandable members results in rapid separation of the divided sections, and the valve assembly moving to the open position, as the eutetic melts. As will be appreciated by reference to FIG. 3, the struts 52, 54 must be sufficiently long enough to allow the valve body member 34, to clear the outlet end 18 and to locate deflector plate 28 at the desired location from the outlet end, to provide the desired spray pattern for the fire extinguishing fluid. The heads 56, 58 are sufficiently larger than the diameter of openings 48, 50 that further downward movement of the valve assembly is restrained, and, moreover, this component of the sprinkler head is then available for use again, in "re-loading" the sprinkler head for use. The length of the struts can, of course, be varied somewhat, depending on the particular deflector plate used, to provide the most effective spray pattern. In this case, the height of the top portion 86 of the housing will be altered accordingly.

The manufacture of a fire sprinkler head of the invention is facilitated by its construction. The valve closure means is first assembled, after which it is then dropped into the top open end of the bottom portion 74 of the housing. Thus, the curved edges 164, 166 come to rest on the annular lip 150. The expandable member 160 is then located in place, followed by placement of the elongated body member, with the valve assembly attached thereto, into the top of the bottom housing portion 74. The expandable members are compressed and the tops of flanges 42 and 84 alined whereby pins 94, 96 are inserted. Lastly the top housing portion 86 is located in place; however, it can be assembled first with the elongated body member, prior to location thereof in the bottom portion 74, if desired.

In resetting a fire sprinkler head, following a fire, wherever such may not have destroyed the building, this can be more readily accomplished, by removal of the sprinkler head from the system. Thus, pins 94, 96 can be extracted (a head, not shown in the drawing can be provided on the end of the pin, to facilitate this extraction, if desired, or the end of the pins and the dead bores can be provided with thread patterns), and the body member 12, etc. removed from bottom portion 74. Then, a valve closure means is then installed, as earlier described, and assembly continued as before.

The valve closure means can be provided of somewhat different and less preferred construction than is shown in FIG. 1, if desired. For example, in an alternative embodiment of the invention, and one of simple construction, the heat responsive means can be merely a member in the shape of a disc provided with a layer of eutectic composition. That heat responsive means is laminated to the divided member by the eutectic composition so that it bridges the dividing line of the divided member and maintains the two divided members intact, until the onset of a fire and the melting of the eutectic composition. In a further embodiment of the heat responsive means, such can comprise a cylindrical-shaped body member of heat conductive material, open at the top and closed at the bottom, a eutectic composition being provided in the composition having a centrally located threaded dead bore, an elongated lock pin having a head at one end of some-what greater diameter than the opening in the divided member, and a thread pattern being provided at the other end, whereby the lock pin can be placed through the said divided member opening and threaded into the eutectic composition, to hold the divided member sections intact until the onset of a fire.

Other modifications and changes, as will be understood, can be made in the invention and its form and construction without departing from the spirit and scope thereof. The embodiments disclosed herein are merely exemplary of the various modifications that the invention can take and the preferred practice thereof. It is not, however, desired to confine the invention to the exact construction and features shown and described herein, but it is desired to include all such as properly come within the spirit and scope of the invention disclosed.

What I claim is:

1. In a fire sprinkler head suitable for mounting in a concealed position in the ceiling in a residential dwelling comprising an elongated body member having an inlet end for connection to a supply of pressurized fire extinguishing fluid and an outlet end for discharge of that fluid onto a fire, a central passageway in said body member connecting said inlet end to said outlet end, an outwardly extending flange at said outlet end connected to and surrounding the said body member, two spaced-apart openings being provided in said flange located on an imaginary line and on opposite sides of said body member, a housing for said elongated body member open at the bottom end thereof and provided with a horizontally disposed, planar top closure through which said inlet end of said body member extends, a valve assembly automatically operable to an open position from a closed position at a predetermined ambient temperature with the onset of a fire comprising a horizontally disposed circular-shaped deflector plate located adjacent to and beneath said outwardly extending flange on said body member, a plurality of horizontally extending teeth being provided uniformly and in spaced-apart location around the circumference of said circular-shaped deflector plate, a valve body member located centrally on and supported by said deflector plate which, when the valve assembly is in its closed position, intrudes into said outlet end, means being located on said valve body member for providing positive seal of said outlet end when the said valve assembly is in the closed position, two spaced-apart vertically disposed elongated struts parallel to one another and each extending through respective said spaced-apart openings in said flange, each said strut being connected at its bottom end to said deflector plate and in combination therewith, the improvement comprising a valve closure means located in the open bottom of said housing for maintaining the valve assembly in the closed position until the attainment of said predetermined ambient temperature with the onset of a fire comprising a planar horizontally disposed member divided into two sections along a dividing line therefor, and being so oriented with respect to the imaginary line along which said spaced apart openings in said flange are located that the said dividing line of the horizontally disposed divided member is perpendicular thereto, and means responsive to heat for maintaining the two sections intact as a unit until the onset of a fire and the attainment of said predetermined ambient temperature surrounding the fire sprinkler head whereby until the onset of a fire and the attainment of said temperature the valve assembly is maintained in the closed position against a positive force predetermined by the said fire extinguishing fluid, a centrally disposed opening being provided in said divided member and being divided by said dividing line, said heat responsive means comprising in combination a horizontally disposed member being constructed of relatively high heat conductive material and having a centrally disposed elongated body member open at the bottom end thereof and having a top closure, an opening being provided in said top closure of predetermined size and said bottom end being determined and surrounded by an annular shaped, planar, horizontally disposed flange, an elongated circular-shaped member having a head at one end of somewhat larger size than the opening in said top closure and extending therethrough, a thread pattern being provided on the circumference of said elongated member at the other end, said other end extending through the centrally disposed opening provided in the said horizontally disposed divided member, an annulus of eutectic composition of predetermined melting point surrounding said threaded elongated member and being disposed between the head of said elongated member and said top closure in the centrally disposed elongated member, an annular shaped insulating member surrounding said elongated member and being disposed between said divided member and said centrally disposed elongated member, and a member provided with an internal thread pattern complementary to that on said elongated member disposed on the side of said horizontally disposed divided member opposite of that of the said insulator, and being threaded onto said elongated member whereby the said divided member, the annular-shaped insulator, the eutectic annulus and heat conductive member are all held together, until the onset of a fire and the attainment of the said ambient temperature.

2. In a fire sprinkler head according to claim 1 wherein the heat responsive means further comprises a member constructed of relatively high heat conductive material and having a generally annular-shape, said member surrounding said elongated member and being located between the said annular-shaped insulator and the centrally disposed elongated body member.

3. In a fire sprinkler head according to claim 2 wherein the heat responsive means further comprises an annular shaped member surrounding said elongated member and located between said insulator and said divided member for providing a greater space therebetween.

4. In a fire sprinkler head according to claim 3 wherein the heat responsive means further comprises a horizontally disposed cover plate of generally annular shape surrounding the said elongated member and being located between the said annular shaped spacer and the insulator.

5. In a fire sprinkler head according to claim 1 wherein the improvement further comprises an annular ring determined by a bottom edge, said ring being connected to and extending vertically downwardly from the bottom of said deflector plate, the bottom edge of said annular ring being in pressing engagement with the top of said horizontally disposed divided member.

6. In a fire sprinkler head according to claim 5 wherein an annular-shaped compressible member in the compressed mode is located within said annular ring and surrounding the said internally threaded member of the heat responsive means whereby, on expanding, the compressible member provides a positive force for disassembly of the valve closure means.

7. Fire sprinkler head suitable for mounting in a concealed position in the ceiling in a residential dwelling comprising an elongated body member having an inlet end provided with an external thread pattern to connect the fire sprinkler to a supply of pressurized fire extinguishing fluid and an outlet end for discharge of said fluid onto a fire, a central passageway in said body member connecting said inlet end to said outlet end, an outwardly extending flange at said outlet end integral with and surrounding the said body member, an elongated housing surrounding said elongated body member open at the bottom end thereof and having a horizontally disposed, planar top closure at the top end, a centrally located opening in said top closure through which said inlet end of the body member extends, a valve assembly automatically operable to an open position from a closed position at a predetermined ambient temperature comprising a horizontally disposed circular-shaped deflector plate located adjacent to and beneath said outwardly extending flange on said body member, a plurality of horizontally extending teeth being provided uniformly and in spaced-apart location around the circumference of said circular-shaped deflector plate, a valve body member located centrally on and supported by said deflector plate which, when the valve assembly is in its closed position, intrudes into said outlet end, means being located on said valve body member for providing positive seal of said outlet end when the said valve assembly is in the closed position, two spaced-apart vertically disposed struts each extending through respective said spaced-apart openings and being connected at their bottom ends to said deflector plate, an annular ring extending vertically downwardly from the said deflector plate and a valve closure means located in the open bottom end of said housing for maintaining the valve assembly in the closed position until the onset of a fire comprising in combination a planar horizontally disposed member divided into two sections along a dividing line therefor and being abutted by said annular ring, a centrally disposed opening being provided in the divided member, and means responsive to heat for maintaining the two sections of the said divided member intact as a unit until the onset of a fire and the attainment of a predetermined ambient temperature surrounding the fire sprinkler head whereby until the onset of a fire and the attainment of said temperature the said valve assembly is maintained in the closed position, said heat responsive means comprising a horizontally disposed member constructed of relatively high heat conductive material, and acting as a heat sink, said horizontally disposed member having a centrally disposed inverted cup-like member defined by a flat bottom and a top annular ring, an opening being provided in said bottom and a horizontally disposed annular-shaped flange extending outwardly from said ring, an elongated cylindrical shaped member having a head of somewhat larger size than the opening in the bottom of said cup-like member provided at one end and extending through said opening in the cup-like member and the said opening in the divided member, a thread pattern on the circumference of the elongated member at the other end, an annular-shaped eutectic composition surrounding said elongated member and being located between the head of the elongated member and the cup like member, an annular-shaped insulator surrounding the said elongated member and being located between the bottom of said cup-like member and the divided member, and a member having a cylindrical-shaped opening therein, a thread pattern being provided in said cylindrical shaped opening, and said threaded member being threaded onto the said elongated member whereby the said inverted cup-liked member, annular-shaped eutectic composition, insulator, and divided member are held intact, until the onset of a fire.

8. Fire sprinkler head according to claim 7 wherein an annular shaped member of heat conductive material is located between the insulator and cup-like member, and abuts, directly against said member.

9. Fire sprinkler head according to claim 8 wherein the outside diameter of the said top annular ring and the annular shaped member of heat conductive material is approximately that of the opening in the bottom of said housing.

10. Fire sprinkler head according to claim 7 wherein the said housing comprises a bottom portion, and a top portion, the bottom portion being of cylindrical shape, open at the top thereof, and an inwardly extending rim defining the bottom for supporting the said divided member.

11. Fire sprinkler head according to claim 10 wherein an outwardly extending flange is provided at, and defines the top of the bottom housing portion, the said outwardly extending flange on the elongated body member being located adjacent thereto, and means for connecting said bottom housing portion to said flange on the elongated body member.

12. Fire sprinkler head according to claim 11 wherein at least two circular horizontally disposed openings, in direct opposition to one another, are provided in the flange on the housing bottom portion, and extending therethrough, and horizontally disposed, circular shaped, dead bores are provided in the flange on the elongated body member, said dead bores being in direct alinement with an opening through the housing flange, and elongated pins being provided which extend through said opening and into respective, said dead bores, whereby the bottom portion of the housing is fixed in relation to, and attached to the elongated body member.

13. Fire sprinkler head according to claim 12 wherein an annular-shaped expandable member in the compressed mode is located within said annular ring projecting downwardly from the deflector plate and between said deflector plate and the said divided member.

14. Fire sprinkler head according to claim 13 wherein a further annular-shaped expandable member in the compressed mode is located between said outwardly extending flange on the elongated body member and the deflector plate.

15. Fire sprinkler head according to claim 10 wherein the said top housing portion is defined by an upwarding extending cylindrical-shaped body portion, open at the bottom thereof and said top body portion is not attached to the bottom housing portion.

16. Fire sprinkler head according to claim 15 wherein the top housing portion is of plastic.

17. Fire sprinkler head according to claim 7 wherein the annular-shaped eutectic composition is at least as thick as the said divided member.

18. Fire sprinkler head according to claim 17 wherein the annular shaped eutectic composition is Cerrobend 158, the inside and outside diameters are 0.0190 inches and 0.030 inches, respectively, and the thickness of the annulus of eutectic composition and the valve locking divided member are both 0.050 inches.

19. Means for maintaining a valve assembly comprising a valve body member and deflector plate supporting said valve body member of a fire sprinkler head comprising a housing having an open bottom end, in the closed position until the attainment of a predetermined temperature with the onset of a fire comprising, in combination, a planar horizontally disposed member divided into two sections of equal size and of the same shape along a dividing line therefor, each of the said two sections having an upper planar surface and said surfaces being coplanar with one another and said two sections abutting one another at said dividing line, and means responsive to heat for maintaining said two sections together and in a horizontally disposed plane until the attainment of said predetermined temperature, said heat responsive means comprising means bridging said dividing line and being in direct engagement with each of said sections on opposite sides of said dividing line and a suitable eutectic composition.

20. Means according to claim 19 wherein said planar horizontally disposed divided member is a disc having a diameter that permits the divided member to be located in the open bottom end of the housing of the fire sprinkler head.

21. Means according to claim 20 wherein the said planar horizontally disposed divided member has a centrally disposed circular-shaped opening provided therein.

22. Means according to claim 21 wherein each of the sections is defined by a curved edge determined by a circle having a radius half the length of said dividing line, said curved edge, in each said section being directly opposed perpendicularly to the dividing line of the said divided member and first parallel, straight edges which are perpendicular to and extend outwardly from said dividing line a predetermined distance, said parallel straight edges being located equidistantly on each side of an imaginary diameter extending to and dividing each said curved edge at its mid point.

23. Means according to claim 22 wherein the ends of the curved edge in each said divided section is determined by second parallel linear edges located equidistantly on each side of said imaginary diameter and extending inwardly a predetermined length toward the dividing line of the divided member and further linear edges joining the inner end of a respective second parallel linear edge to the outer ends of a first parallel linear edge.

24. Means according to claim 21 wherein the bridging means comprises a cup-like means for holding and containing the eutectic composition.

25. Means according to claim 19 wherein the said bridging means is a heat conductive retainer having a cylindrical-shaped body member open at the top and closed at the bottom, and said eutectic composition is located in said retainer, a centrally located, threaded dead bore being provided in said eutectic composition, an elongated lock pin having a head at one end of somewhat greater diameter than the said opening in the divided member, and a thread pattern being located at the other end, whereby the lock pin can be placed through the said divided member opening and threaded in said eutectic composition, to hold the divided member sections intact until the onset of a fire.

26. Means according to claim 19 wherein the said divided member has a centrally disposed circular-shaped opening therein and is defined by curved edges in opposition to one another on opposite sides of the dividing line and parallel linear edges, located equidistantly on opposite sides of an imaginary line intersecting and dividing said curved edges and each said parallel line intersecting perpendicularly said dividing line for the divided member.

27. Means according to claim 26 wherein the said bridging means is an annular-shaped spacer ring and wherein the heat responsive member further comprises a horizontally disposed member comprising a cylindrical-shaped, centrally disposed body member having an open bottom, a planar top closure, and a centrally disposed opening in said top closure, an outwardly extending flange of relatively high heat conductive material defining the said open bottom, an annular-shaped heat collecting member being located adjacent to said top closure and directly thereagainst, an annular-shaped insulator being located next adjacent said heat collecting member and adjacent said bridging means, an annular-shaped eutectic composition being located within said cylindrical-shaped body member and directly adjacent said top closure, an elongated lock screw having a head at one end of larger diameter than the opening in said eutectic composition and closure and extending through the said annular-shaped eutectic composition, top closure, annular-shaped heat collecting member, annular-shaped insulator, annular-shaped spacing ring, and the centrally disposed opening in said divided member, a thread pattern being provided on the other end of the elongated lock screw, and an internally threaded member being threaded on the lock screw whereby the said components of the heat responsive means are held together, and the two sections of the divided member intact, until the onset of a fire and a rise in the ambient temperature sufficient to melt the eutectic composition.

28. Means according to claim 27 wherein the heat responsive means further comprises an annular-shaped decorative plate located between said spacer and the annular-shaped insulator whereby the bottom opening in the housing for the sprinkler head is covered from view.

29. Means according to claim 28 wherein the annular-shaped eutectic composition is at least as thick as the said divided member.

30. Means according to claim 29 wherein the annular-shaped eutectic is Cerrobend 158, the inside and outside diameters thereof are 0.0190 and 0.030 inches, respectively, and the thickness of the annulus of eutectic composition is 0.050 inches.

31. Means according to claim 19 wherein said planar horizontally disposed divided member is a disc having a diameter that permits the divided member to be located in the open bottom end of the housing of the fire sprinkler head, and said bridging means comprises a disc of lesser diameter, the said eutectic composition being in a layer sandwiched between said divided member and said bridging means and laminating the said bridging means to the said divided member.

* * * * *